United States Patent [19]

Rosegren et al.

[11] 4,411,965

[45] Oct. 25, 1983

[54] PROCESS FOR HIGH SPEED NICKEL AND GOLD ELECTROPLATE SYSTEM AND ARTICLE HAVING IMPROVED CORROSION RESISTANCE

[75] Inventors: Donald R. Rosegren, Cresskill; Linda J. Mayer, Denville, both of N.J.

[73] Assignee: Occidental Chemical Corporation, Warren, Mich.

[21] Appl. No.: 407,661

[22] Filed: Aug. 16, 1982

Related U.S. Application Data

[63] Continuation-in-part of Ser. No. 202,410, Oct. 31, 1980, abandoned.

[51] Int. Cl.[3] ..... C25D 5/12

[52] U.S. Cl. ..... 428/672; 204/40; 204/49

[58] Field of Search ..... 204/40, 49, 43 T, 112, 204/123; 428/672

[56] References Cited

U.S. PATENT DOCUMENTS

| | | | |
|---|---|---|---|
| 2,905,601 | 9/1959 | Rinker et al. | 204/43 G |
| 3,364,064 | 1/1968 | Wijburg | 204/40 X |
| 3,708,405 | 1/1973 | Kamata | 204/37 R |
| 4,016,050 | 4/1977 | Lesh et al. | 204/15 |

*Primary Examiner*—G. L. Kaplan
*Attorney, Agent, or Firm*—Richard P. Mueller

[57] ABSTRACT

A method of electrodepositing a gold alloy layer having improved corrosion protection is disclosed. Prior to the gold layer an underlayer of ductile, low-stress nickel is electrodeposited from a solution containing ortho-formyl benzene sulfonic acid and perfluorocyclohexyl potassium sulfonate.

11 Claims, No Drawings

PROCESS FOR HIGH SPEED NICKEL AND GOLD ELECTROPLATE SYSTEM AND ARTICLE HAVING IMPROVED CORROSION RESISTANCE

The application is a continuation-in-part of application Ser. No. 202,410, filed Oct. 31, 1980 and now abandoned.

The present invention relates to the electrodeposition of gold on substrates. More particularly, the invention pertains to improving the corrosion resistance of cobalt-hardened gold coatings which are electrodeposited on various substrates.

BACKGROUND OF THE INVENTION

It is well known in the metallizing art to electrodeposit, also referred to as electrolytic deposition and electroplating, cobalt-hardened gold coatings on substrates. In conventional procedures a deposition bath comprising ions of metal to be deposited and a suitable electrolyte is provided, the article or object to be plated is immersed in or otherwise contacted with the bath while connected as the cathode to an external current source, and a metal electrode is connected as the anode to the same current source. During electroplating operations ions of the metal to be deposited are reduced in the bath to zero valent metal which plates out on the workpiece or substrate surface.

The use of cobalt to harden gold coatings is described, for example, in U.S. Pat. No. 2,905,601 which will be discussed below in greater detail.

It has been found, however, that such conventional cobalt-hardened gold coatings do not have the high degree of corrosion resistance which is an important property for some commercial purposes. Thus, it would be desirable to provide a system or process for preparing special cobalt-hardened, gold electrodeposits with markedly improved corrosion resistance and cosmetic appearance such as brightness, smoothness. In some instances it has been possible to achieve such desirable results at substantially reduced thicknesses of metal.

SUMMARY OF THE INVENTION

In accordance with the present invention it has now been found that cobalt-hardened gold coatings having improved corrosion resistance can be obtained by initially coating the workpiece or substrate with a ductile, stress-free nickel deposit.

The necessary nickel coating on the substrate is derived from a specially prepared electroplating bath which, preferably, can be utilized with insoluble anodes. In general, the nickel electroplating baths will contain a nickel salt such as nickel sulfate, as a source of nickel ions, and boric acid or citric acid as the electrolyte. Although other conventional additives may be employed, it has been found essential to use ortho-formyl benzene sulfonic acid as the brightener and perfluorocyclohexyl potassium sulfonate, as the wetting agent.

Following the electrodepositing of the ductile, stress-free nickel coating the workpiece is subjected to the electrodeposition of the outer coating comprising cobalt-hardened gold.

By practicing the foregoing sequential electrodeposition steps the cobalt-hardened gold coating was characterized by a superior corrosion resistance as compared to the corrosion resistance of the same cobalt-hardened gold coating without the intermediate ductile, stress-free nickel coating. On the other hand, the superior corrosion was not attained even with the intermediate ductile, stress-free nickel coating when the gold was hardened with, for example, iron rather than cobalt.

Corrosion resistance is measured by Western Electric's manufacturing specification WL 2316.

DETAILED DESCRIPTION OF THE INVENTION

The nickel salt electroplating bath useful in the initial coating step of the present invention will have the following formulation:

| Component | Concentration g/l |
|---|---|
| Nickel Salt | 30 to 105 (as Ni) |
| Electrolyte | 20 to 100 |
| O—formyl benzene sulfonic acid | 0.25 to 3.0 |
| Perfluorocyclohexyl potassium sulfonate | 0.02 to 0.2 |

The preferred sources of the nickel metal are nickel sulfate, nickel citrate, nickel carbonate, and the like. These salts are preferably employed in an amount of from about 135 to 470 g/l to provide the desired nickel metal concentration.

Electrolytes which are most useful for the present purposes are boric acid, citric acid, and the like. The preferred amounts used in preparing the electroplating baths of this invention will range from about 22.5 to 45 g/l. The use of boric acid is especially preferred.

The organic components of the nickel bath are usually the brighteners and the wetting agents. In formulating the special electroplating bath of this invention the specific brightener employed is ortho-formyl benzene sulfonic acid. The required wetting agent is perfluorocyclohexyl potassium sulfonate, which has the formula:

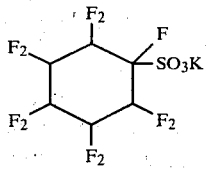

For most purposes the pH of the electroplating bath is adjusted to a range of about 2 to 5, preferably 2.5 to 4.5. The compounds used to effect the pH adjustment include nickel carbonate, sulfuric acid, potassium citrate, or citric acid.

The baths of the present invention are operated at temperatures of about 46 to 57 degrees C. and at relatively high current density of up to about 1000 ASF, and preferably about 100 to 600 ASF. The ability to use such high current densities is another important advantage of the electroplating baths of the present invention.

Nickel deposited on various substrates when utilizing the baths of this invention are characterized by being semibright, ductile, and low-stressed. Furthermore, it is possible to use insoluble anodes in carrying out both the initial and second coating steps. The insoluble anodes which can be employed include, for example, platinized titanium, platinized tantalum, platinized columbium (niobium) as well as a platinum metal anode itself. Additionally, titanium anodes having mixed oxide coatings, such as ruthenium dioxide-titanium dioxide coatings, may also be used.

The electroplating of hardened gold deposits can be carried out utilizing the baths and the processes described in U.S. Pat. No. 2,905,601 Rinker and Duva (1959). The disclosure of this patent is, therefore, incorporated herein by reference. Although cobalt-hardened gold outer coatings are preferred, it will be understood that other metal hardeners such as indium, or nickel may also be employed in the practice of the present process which involves the use of a high speed gold treating process following the application of a high speed nickel treating process to form the initial or intermediate coating on the substrate or workpiece.

The electroplating bath useful for the gold plating step will comprise (1) a weak, stable, organic acid, (2) gold as a cyanide (potassium gold cyanide, for example), and (3) one or more base metal salts soluble in the bath.

Examples of acids which may be employed are formic, acetic, citric, tartaric, lactic, kojic, or similar acids and mixtures of these acids. The acid should be present in proportions of about 10 to 150 grams per liter and may be partially neutralized with ammonium or alkali hydroxide to give a pH of about 3–5. It is this weak organic acid and the procedure of maintaining the bath within a limited pH range that produces the desired effect of a gold alloy deposition.

The gold may be added as the double cyanide of gold and an alkali metal, potassium gold cyanide for example, and may be present in proportions of about 8 grams per liter to 26 grams per liter of gold, preferably 12.

Base metal salts which may be added comprise the sulfates, sulfamates, formates, acetates, citrates, lactates, tartrates, fluoborates, borates, phosphates, etc., of nickel, zinc, cobalt, indium, iron, manganese, antimony, copper, etc. These metal salts are added in the proportion of from 0.5 to 5 grams per liter. Very satisfactory results are obtained when two of such base metal salts are included in the bath. Although the addition of base metal salt is necessary, it does not matter which salt or mixture of salts is added as long as the added salts are soluble and compatible with all other bath ingredients.

The bath may be operated at a current density of 1 to 100 amperes per square foot. Moderate to rapid agitation improves the operation. The bath may be operated at normal room temperature (70° F.) which is advantageous in that no themostatic regulation is necessary but higher or lower temperatures of from 50 degrees to 120 degrees F. may be employed. The maximum cathode/anode ratio should be about 4:1.

The preferred electroplating bath useful for the second coating step will have the following formulation:

| Component | Concentration g/l |
|---|---|
| Acetic Acid and Sodium Citrate | 100 to 300 |
| Formic Acid | 10 to 50 mls/l |
| Gold (as potassium gold cyanide) | 12 to 26 |
| Cobalt (as sulfate) | 0.5 to 1.75 |
| Water | Remainder |

The invention will be more fully understood by reference to the following illustrative embodiment:

EXAMPLE

A first electrolytic bath was prepared by dissolving the following components:

| | g/l |
|---|---|
| Nickel (as sulfate) | 75 |
| Boric Acid | 40 |
| O—Formyl Benzene Sulfonic Acid | 1.5 |
| Perfluorocyclohexyl potassium sulfonate | 0.1 |
| Water | Remainder |

A second electrolytic bath was prepared by dissolving the following components:

| | g/l |
|---|---|
| Citric Acid (as potassium citrate) | 200 |
| Formic Acid | 20 mls/l |
| Gold (as potassium gold cyanide) | 12 |
| Cobalt (as sulfate) | 1.5 |
| Water | Remainder |

The pH of this bath is adjusted to about 4.8 to 5.2 by the addition of an alkali or acid.

Run A

The substrate, commercial copper plated circuit board, is first treated in the nickel electroplating bath to give a semi-bright, ductile, and stress-free nickel deposit having a thickness between about 2.5 to 5$\mu$. The thus coated substrate is then treated in the second or gold electroplating bath to give a bright, smooth, and hard gold deposit. This coating has a thickness of from about 1 to 2$\mu$. The corrosion resistance of the resulting product, as measured in accordance with Western Electric's manufacturing specification WL 2316, is found to be outstanding.

Run B

When the step of electrodepositing the nickel coating is omitted, the resulting product's corrosion resistance is substantially reduced.

What is claimed is:

1. A process for obtaining an improved corrosion-resistant gold plating on a substrate which comprises the following sequential plating steps:

(a) electrodepositing a ductile, stress-free nickel coating on said substrate from an electroplating bath containing a nickel salt, an electrolyte selected from the group consisting of boric acid, and citric acid, ortho-formyl benzene sulfonic acid, and as a wetting agent, perfluorocyclohexyl potassium sulfonate; and (b) electrodepositing a base metal hardened gold coating on the resulting ductile, stress-free nickel plated substrate from an electroplating bath containing a gold salt, an electrolyte selected from the group consisting of acetic acid, citric acid, formic acid and mixtures thereof, and a metal salt hardener selected from the group consisting of cobalt, indium, nickel, zinc salts and mixtures thereof.

2. The process of claim 1 wherein the nickel salt is nickel sulfate and the electrolyte is boric acid.

3. The process of claim 1 wherein electroplating bath (a) is operated at a pH of 2 to 5.

4. The process of claim 1 wherein the electrodeposition steps (a) and (b) are carried out with insoluble anodes.

5. The process of claim 1 wherein the gold salt is a gold cyanide salt.

6. The process of claim 5 wherein said electroplating bath (b) utilizes potassium gold cyanide.

7. The process of claim 1 wherein said electroplating bath (b) utilizes acetic acid as the electrolyte.

8. The process of claim 1 wherein said electroplating bath (b) utilizes cobalt sulfate as the base metal salt.

9. The process of claim 1 wherein said electroplating bath (b) utilizes citric acid as the electrolyte.

10. The process of claim 1 wherein said electroplating bath (b) utilizes formic acid and citric acid as the electrolyte.

11. A substrate having formed thereon a cobalt-hardened gold/low stress nickel composite coating with improved corrosion resistance prepared by the process of claim 1.

* * * * *